United States Patent [19]

Hewelt et al.

[11] 4,371,247

[45] Feb. 1, 1983

[54] ARRANGEMENT FOR ELIMINATING AMMONIA VAPORS FROM DEVELOPED DIAZO COPY MATERIAL

[75] Inventors: Robert K. Hewelt, 3275 Hagerman, Leonard, Mich. 48038; Edward F. Dohring, Westland, Mich.

[73] Assignee: Robert K. Hewelt, Leonard, Mich.

[21] Appl. No.: 148,635

[22] Filed: May 12, 1980

Related U.S. Application Data

[62] Division of Ser. No. 36,478, May 7, 1979, Pat. No. 4,273,435.

[51] Int. Cl.[3] ..... G03D 7/00

[52] U.S. Cl. ..... 354/300; 355/106

[58] Field of Search ..... 354/299, 300, 339; 34/36, 37, 72, 79, 80, 140, 155; 355/27, 100, 106

[56] References Cited

U.S. PATENT DOCUMENTS

| | | | |
|---|---|---|---|
| 3,710,708 | 1/1973 | Schuman et al. | 355/106 |
| 3,915,708 | 10/1975 | Zausmer et al. | 34/155 |
| 4,059,409 | 11/1977 | Barto et al. | 354/300 |
| 4,092,658 | 5/1978 | Schröter | 354/300 |
| 4,109,268 | 8/1978 | Schröter et al. | 354/300 |
| 4,241,989 | 12/1980 | Jackson | 354/300 |

FOREIGN PATENT DOCUMENTS

| | | | |
|---|---|---|---|
| 2731490 | 1/1978 | Fed. Rep. of Germany | 354/299 |
| 1062560 | 3/1967 | United Kingdom | 354/300 |

*Primary Examiner*—Richard A. Wintercorn
*Assistant Examiner*—Alan Mathews
*Attorney, Agent, or Firm*—Krass, Young & Schivley

[57] ABSTRACT

A method and arrangement for achieving a thorough degassing of developed diazo copy material to eliminate the ammonia vapors permeating the developed diazo copy material as a result of the development process. The developed copy is moved from a development chamber containing the developing vapors into a degassing chamber, where the developed copy material is passed over a heated surface in intimate contact therewith to drive out the ammonia from the copy material. The ammonia vapors are carried away by a suction pump or fan to an external ammonia absorbing canister. In a first version, the heated contact surface is provided by a heated tube about which the developed print is drawn after passing off a developer-drive cylinder. In a second version, the developer-drive cylinder moves the developed copy material past a longitudinal seal engaging the drive cylinder, with the region on one side of the seal comprising a heated development chamber, while the region on the other side of the seal is subjected to a suction to evacuate the ammonia vapors. A heated, trough-shaped steel metal guide is positioned to receive and guide the developed copy material out of the machine to augment the degassing effect provided by contact with the heated developer-drive cylinder in the region subjected to suction.

3 Claims, 2 Drawing Figures

ARRANGEMENT FOR ELIMINATING AMMONIA VAPORS FROM DEVELOPED DIAZO COPY MATERIAL

CROSS-REFERENCE TO RELATED APPLICATION

This application is a division of application Ser. No. 36,478, filed May 7, 1979, now U.S. Pat. No. 4,273,435.

BACKGROUND DISCUSSION

This invention relates to diazo copies and particularly to eliminating the release of ammonia vapors into the air incidental to the operation of these copying machines. Diazo copiers employ ammonia vapors in contact with the exposed copying material in order to develop the print. This use of ammonia results in the emanation of some ammonia vapors into the surrounding area as a result of trace leakage from the machine itself with the highly pungent ammonia creating disagreeable working conditions for those in the vicinity of the copying machine.

In addition, the copy material usually being fibrous, such as paper or fabric, the ammonia vapors permeate the material itself such that the ammonia vapors are released in handling the prints after they have been removed from the machine. If a large number of prints are being run, the release of ammonia vapors can be considerable. If the prints are stacked, the ammonia is trapped within the paper and will be released upon subsequent handling of the prints.

Efforts to prevent the release of such ammonia vapors have led to several approaches which have been taken in the past. The most common expedient is the provision of a vacuum chamber through which the copy material passes after leaving the development chamber whereat the copy material is treated with the ammonia vapors. The vacuum chamber creates a negative pressure or suction which removes the ammonia vapors to the extent possible and passes the air through an absorption canister prior to being reexhausted into the room air. While reasonably effective in removing the vapors which leak from the development chamber, the vapors carried within the developed copy material itself will not be entirely removed, such that the ammonia vapor odor will still be detectable in handling of the blueprints, and if large numbers of copies are run, the entire area may be present with ammonia odor.

In U.S. Pat. No. 3,915,708, there is described an effective means for reducing the release of ammonia vapor by the addition of carbon dioxide vapor to the developing ammonia-water vapor mixture, and which reduces the ammonia odor problem. Again, the ammonia odor problem associated with the paper material itself is not entirely eliminated.

It has heretofore been recognized, as described in U.S. Pat. Nos. 4,109,268 and 4,092,658, that heating of the copy material in conjunction with the application of suction may more effectively remove such ammonia vapors from the paper itself. However, as described in these patents, the application of heat to paper is relatively difficult since the paper tends to become pleated or warped upon direct application of excessive heat to the paper, particularly in conjunction with mechanical stress of the paper material. The arrangement set forth in these patents includes elaborate infrared sources which are employed to indirectly cause heating of the paper, with a vacuum applied in the chamber downstream of the development chamber.

Accordingly, it is an object of the present invention to provide an effective, essentially complete degassing of the copy material after the development process such as to substantially eliminate the odor problem associated with the prints developed, as well as that leaking from the machine by being carried out of the development chamber with movement of the paper material.

It is a further object of the present invention to provide such an arrangement in which the paper material is not stressed either thermally or mechanically in such a way as to avoid the formation of waviness or pleats in the paper copy material while employing relatively simple apparatus and does not necessitate complicated controls over the application of heat.

SUMMARY OF THE INVENTION

These and other objects of the present invention, which will become apparent upon a reading of the following specification and claims, are achieved by the arrangement of a suction chamber through which the developed copy material is passed and in which suction chamber the developed copy material is caused to be passed in contact with a heated surface, over an effective distance of a heated surface to a temperature on the order of 180°–250° F. This treatment effectively degasses substantially totally the paper material of the ammonia vapors without causing the imposition of thermal and mechanical stresses which would tend to produce pleating or waviness in the paper copy material.

In a first version of the invention, the heated surface is comprised of a stationary hollow tube within which is mounted a heater element, with the copy material being wrapped and drawn across the outside surface of the tube by means of a windup roller, the tube located in a vacuum or degassing chamber receiving the copy material after it exits the development chamber.

In a second version, the use of copying apparatus includes a developer-drive cylinder with a layer of Teflon mesh mounted across the open side of a developer-drive cylinder which drives the diazo copy material by rotation of the developer-drive cylinder, the copy material drawn beneath the Teflon mesh layer. In this version, the trough housing is partitioned by a longitudinal trough housing seal in engagement with the developer-drive cylinder which serves to partition the trough housing into a development chamber and a degassing or suction chamber.

A heater element in the development chamber serves to heat the developer-drive cylinder such that the developed copy material is heated in an evacuation chamber by being maintained in position on the developer-drive cylinder as it enters into the degassing chamber in moving under the longitudinal trough housing seal. In addition, a reversely curved guide surface is positioned to receive the developed copy material after passing off the developer-drive cylinder, and a heater element serves to heat the inside surface thereof, and which continues to heat the copy material as the developed copy passes over the inside surface of the reversely curved guide surface and out of the machine.

In both versions, the degassing chambers are evacuated by means of a pump or fan which directs the released ammonia vapors through an absorption canister prior to being recirculated into the room air.

In both versions, the use of the carbon dioxide vapor in the development vapor mixture is employed to enhance the basic odor eliminating effect of the invention.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
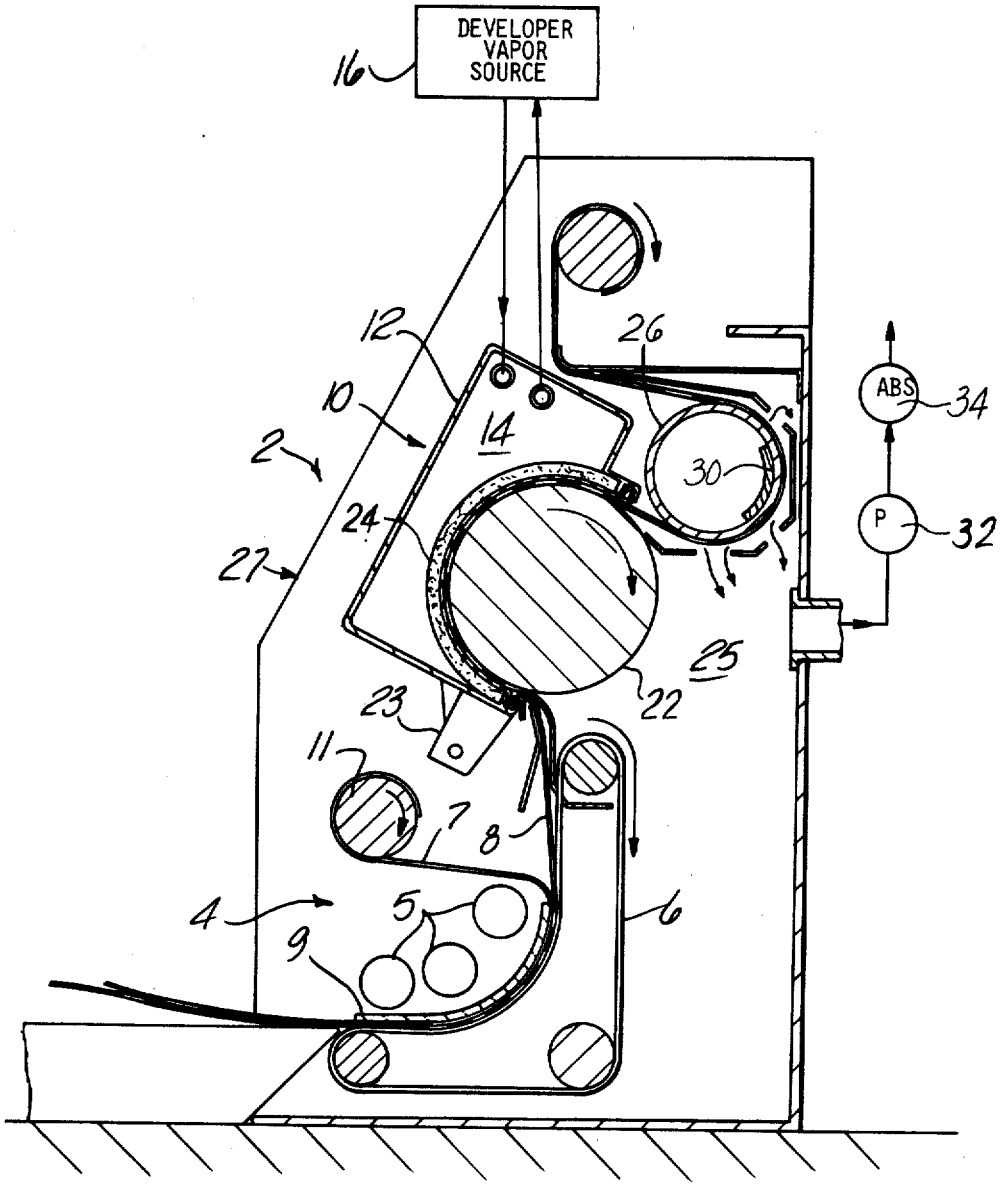
FIG. 1 is a diagrammatic view of a diazo copier in transverse section depicting the details of the degassing chamber and the heated contact surface.

Referring to FIG. 1, a diagrammatic representation of a diazo copying machine 2 incorporating one embodiment of the invention is depicted. This representation is only of the essentials, as the details of construction of such machines are well known to those skilled in the art.

The copy material is received in an exposure section 4 where it is exposed to a light bar arrangement consisting of a ground of florescent tubes 5 prior to entering the development section. A drive belt 6 drives the original 7 and the copy material 8 beneath a transparent guide 9, with the original 7 being taken up on a rewind roller 11.

The developer section is generally indicated at 10 and includes a developer trough housing 12, the interior 14 of which constitutes a developer chamber supplied with developing ammonia vapor from an ammonia vapor supply system as indicated at 16.

In the preferred embodiment of the present invention, the ammonia vapor supply is of a nature described in U.S. Pat. No. 3,915,708, which is hereby incorporated by reference. This patent describes an ammonia vapor supply in which carbon dioxide gas is dissolved in an ammonia-water solution and which is found to operate in conjunction with the degassing arrangement according to the present invention to order to totally eliminate the ammonia vapor odor problem. This solution is a concentration of carbon dioxide/ammonia mixture in parts by weight ranging from 1:1 to 1:20 and the concentration of the ammonia is at least about one pound per gallon of solution. From this solution, a vapor mixture of carbon dioxide and water is caused to flow into the interior of the developer trough housing 14 by various arrangements well known to those skilled in the art and described in the aforementioned U.S. Patents.

This vapor coming into contact with diazo coated copy material 8 causes a reaction by which the print image is developed. The developer trough housing 12 has mounted across its open side a Teflon mesh layer which is normally pressed against the exterior of the developer-drive cylinder 22 and is of sufficient width to conform thereto.

According to one aspect of the invention, the developer trough housing 12 is adapted to be pivotally mounted such as to be moved into and out of engagement with developer-drive cylinder 22 by means of a pair of brackets 23 at either end of the housing which are pivotally mounted to the machine frame indicated generally at 27. Thus, ready maintenance access to the interior of developer section 10 is afforded.

End seals indicated at 24 and located at either end of the developer-drive cylinder 22 and developer trough housing 12 serve to define a sealing of the developer trough housing interior 14.

The development vapors pass through the mesh and into contact with the copy material 8 to be developed to carry out the development, the Teflon mesh layer 20 serving to force the copy material against the exterior of the developer-drive cylinder 22.

Developer-drive cylinder 22 is adapted to rotate in the direction indicated by a drive system (not shown) such that copy material fed into and between the Teflon mesh layer 20 and the developer-drive cylinder 22 is advanced through the developer section 10 moving around with the exterior of the developer-drive cylinder 22.

The vapor exiting the developer section 10, according to the concept of the present invention, passes into contact with a heated tube 26 passing about the exterior of the heated tube 26 and out through the machine where it is wound up on a wind-up roller 28. Thus, the copy material is maintained in intimate contact therewith as it is drawn tightly over the exterior of the heated tube 26.

A heater tape 30 is mounted to the interior of the heated tube 26 and serves to warm the tube to a temperature on the order of 180°-200° F. At this temperature and the length of engagement with the tube and the paper, the ammonia vapor trapped within the fibers of paper or fabric is substantially completely driven off into the surrounding area about the heated tube 26.

A tube three inches in diameter with a slightly greater than 180° contact with the heated tube 26 exterior surface has been found to provide adequate warming of the paper to carry out the substantial total degassing without the imposition of thermal stresses such as would tend to distort the paper in a wavy pattern therein. The vapors so driven off are collected by a suction applied to the region. The adjacent exposed side of the developer-drive cylinder 22 and the heated tube 26 define a degassing chamber 25. Such is achieved by conventional means such as an air pump or fan 32, the discharge of the air pump 32 passing through a canister ammonia absorber 34 prior to being circulated into the air.

It has been discovered that direct contact with the heated surface over an effective distance, i.e., on the order of several inches, 3 to 6 inches, produces a direct heating of the paper itself by relatively simple means while avoiding the imposition of severe mechanical and thermal stresses. The resultant relatively moderate temperatures have been found to enable substantially complete degassing of the paper such that even at relatively high speed development, the ammonia vapor problem is eliminated both from the machine leakage and from emanation from the developed copy material itself.

Figure 2:
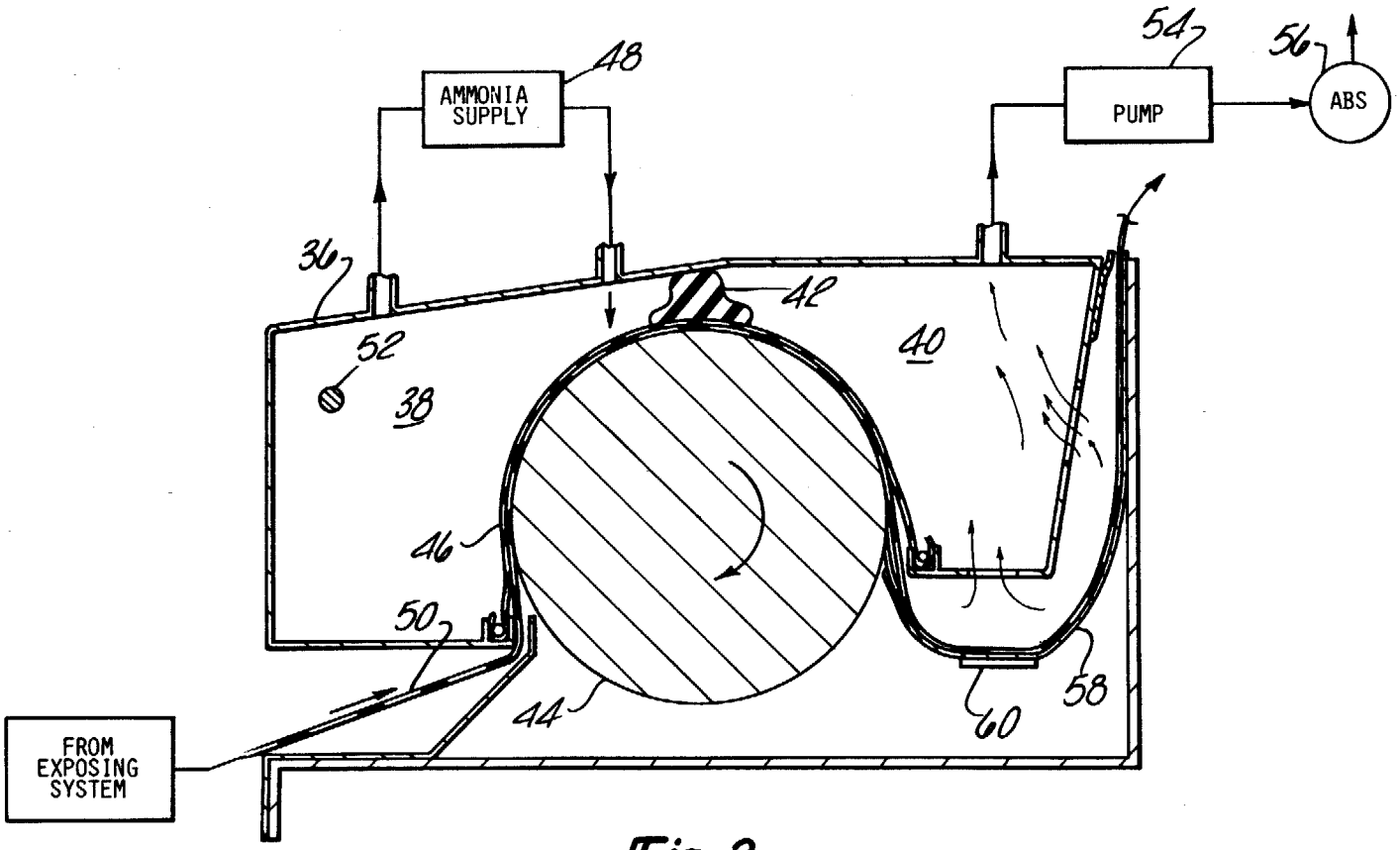
FIG. 2 is a view in transverse section of an alternate version of the arrangement according to the present invention.

Referring to FIG. 2, an alternate version of this arrangement is depicted in which a slower speed of the paper through the machine is possible, i.e., for relatively low speed operations. In this version, a development trough housing 36 is partitioned into a developing chamber 38 and a degassing chamber 40 by an intermediate trough housing seal 42 extending down the full length of the trough housing 36.

As in the above-described embodiment, the trough housing 36 is positioned in engagement with a developer-drive cylinder 44 which is contacted by a trough-shaped length of Teflon mesh 46 mounted in the trough housing 36 which is pressed into contact with a portion of the exterior of the developer-drive cylinder 44.

Paper fed into the space between the Teflon mesh layer 46 and the developer-drive cylinder 44 is driven while in contact with the developer-drive cylinder and the developer-drive cylinder is rotated by a drive means (not shown).

In the developing chamber 38, an ammonia supply system 48 circulates a developing ammonia vapor of the type described in the aforementioned U.S. Patent, which is passing through the Teflon mesh layer 46 coming into contact with the copy material 50 as it passes through the developing chamber 38. A heater 52 causes heating of the developing chamber to enhance the development process in a manner well known to those skilled in the art.

The Teflon mesh layer 46 and paper pass beneath the neoprene trough housing seal 42 which engages the exterior of the Teflon mesh 48 and creates a sealing engagement such as to prevent the exiting of ammonia vapors from the developing chamber 38.

This seal is preferably of a foamed closed cell extrusion which provides adequate sealing while maintaining a relatively light contact pressure on the developer-drive cylinder 44 exterior. Suitable seals are commercially available.

The degassing chamber 40 is defined by the side of the interior of the trough housing 36 to the right of the trough housing 42 as viewed in FIG. 2.

The heater 52 causes the developer-drive cylinder 44 to also be heated such that the segment of the developer-drive cylinder 44 exterior acts as a heated contact surface in the manner of the heated tube incorporated in the first described embodiment, to tend to drive off the residual ammonia vapors. These vapors are collected in the degassing chamber 40 by means of suction developed by a pump 54, circulating the collected vapors through an absorber canister 56 of a well known type, prior to recirculating the air to the surrounding room area.

In order to augment the effect of the contact with the developer-drive cylinder 44, a further heated contact surface is provided defined by a generally U-shaped sheet metal guide 58 which is positioned to receive the copy material after passing off the developer-drive cylinder 44. The tendency for the paper to straighten as it comes off creates a tendency for the paper to follow around the inside surface of the U-shaped guide 58 passing out of the machine as indicated.

A length of heater tape 60 is affixed to the opposite side of the U-shaped guide 58 to cause this surface to be heated to the appropriate 180°-200° F. temperature and causes a further degassing, which vapors are collected through an opening through the trough wall to also be evacuated by the pump 54.

Accordingly, it can be seen that a very effective means for carrying out degassing of the developed copy material by heating thereof has been provided which is relatively simple, and yet provides highly efficient application of the heat energy to the copy material, while avoiding the imposition of excessive thermal and mechanical stressing of the material itself, such that it exits the machine totally dry, odor free and remains undistorted.

The embodiments of the invention in which an exclusive property or privilege is claimed are defined as follows:

1. A diazo copying machine for developing diazo copy material comprising:

a machine frame;

a development chamber;

means for circulating developer gases through said chamber;

means for causing exposed diazo copy material to be passed through said development chamber, said means including a drive cylinder and means for rotating said cylinder;

said development chamber being comprised in part by a trough extending along the length of said drive cylinder and including means positioning the open face of said trough against said drive cylinder;

a mesh layer secured extending across said open face of said trough to be pressed against said drive cylinder, with said trough in position against said drive cylinder;

feed means for feeding said exposed copy material between said drive cylinder and said mesh layer;

said means positioning said trough including pivotal support means retaining the trough to the frame and enabling swinging movement of said trough about said support means towards and away from said position against said drive cylinder, whereby said trough can be selectively positioned away from said drive cylinder for ready access to the interior thereof for maintenance thereof.

2. The diazo copying machine according to claim 1 wherein said mesh layer is of Teflon.

3. The diazo copying machine according to claim 1 wherein said trough is formed with endwalls having partially circular cutouts corresponding to said drive cylinder diameter adapted to move into partially surrounded engagement with said drive cylinder and further including end seals mounted in said cutouts and moved into sealing engagement with said drive cylinder exterior upon movement of said trough into position against said drive cylinder.

* * * * *